US009546517B2

(12) United States Patent
Zhou

(10) Patent No.: US 9,546,517 B2
(45) Date of Patent: Jan. 17, 2017

(54) CONTINUOUS ROTARY DRILLING SYSTEM AND METHOD OF USE

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 448 days.

(21) Appl. No.: 13/782,567

(22) Filed: Mar. 1, 2013

(65) Prior Publication Data

US 2013/0228379 A1 Sep. 5, 2013

Related U.S. Application Data

(60) Provisional application No. 61/605,447, filed on Mar. 1, 2012.

(51) Int. Cl.
*E21B 17/06* (2006.01)
*E21B 17/05* (2006.01)
(Continued)

(52) U.S. Cl.
CPC . *E21B 7/06* (2013.01); *E21B 3/04* (2013.01); *E21B 17/046* (2013.01); *E21B 17/05* (2013.01); *E21B 17/20* (2013.01); *E21B 17/043* (2013.01)

(58) Field of Classification Search
CPC ..... E21B 17/043; E21B 17/05; E21B 17/06
See application file for complete search history.

(56) References Cited

U.S. PATENT DOCUMENTS 1,883,071 A * 10/1932 Stone ..... 166/194
2,067,377 A * 1/1937 Burns et al. ..... 464/21
(Continued)

FOREIGN PATENT DOCUMENTS

CA 2237309 A1 8/1998
EP 2 108 780 A1 10/2009
(Continued)

OTHER PUBLICATIONS

Gelfgat, Yakov A., USSR Inventor Certificate # 1815324, "Device for Continuous Movement and Rotation of Drillstring", Priority Date Jul. 6, 1987, Registered May 15, 1993.
(Continued)

*Primary Examiner* — Frederick L Lagman
(74) *Attorney, Agent, or Firm* — Bracewell LLP; Constance G. Rhebergen; Keith R. Derrington

(57) ABSTRACT

A drilling system has a drill string that is made up of tubular segments of coiled tubing joined together by connectors. The connectors can be selectively changed between locked and unlocked configurations. When in the unlocked configuration adjacent tubular segments rotate with respect to one another, and when in the locked configuration the tubular segments are rotationally affixed. The connectors include clutch members coupled to each tubular segment, that axially slide into a slot formed in an adjacent tubular segment to rotationally lock the adjacent segments. A Kelly bushing and rotary table rotate the drill string; and an injector head is used to insert the drill string through the Kelly bushing and rotary table and into a wellbore. While the drill string is inserted through the bushing and table, the connectors are set into the locked configuration so that all tubular segments from the rotary table downward are rotationally affixed.

19 Claims, 9 Drawing Sheets

(51) Int. Cl.

| | |
|---|---|
| ***E21B 7/06*** | (2006.01) |
| ***E21B 3/04*** | (2006.01) |
| ***E21B 17/046*** | (2006.01) |
| ***E21B 17/20*** | (2006.01) |
| *E21B 17/043* | (2006.01) |

(56) References Cited

U.S. PATENT DOCUMENTS

| | | | | |
|---|---|---|---|---|
| 2,978,048 | A * | 4/1961 | Walker | 175/294 |
| 3,361,453 | A * | 1/1968 | Brown | E21B 17/046 285/321 |
| 3,502,353 | A * | 3/1970 | Burns | 285/2 |
| 4,232,751 | A | 11/1980 | Trzeciak | |
| 5,195,586 | A * | 3/1993 | Gambertoglio | 166/240 |
| 6,129,160 | A | 10/2000 | Williams et al. | |
| 6,244,345 | B1 | 6/2001 | Helms | |
| 6,378,630 | B1 | 4/2002 | Ritorto et al. | |
| 6,408,955 | B2 | 6/2002 | Gipson | |
| 6,446,737 | B1 | 9/2002 | Fontana et al. | |
| 6,516,892 | B2 | 2/2003 | Reilly | |
| 6,915,865 | B2 | 7/2005 | Boyd | |
| 7,007,753 | B2 * | 3/2006 | Robichaux et al. | 166/291 |
| 7,469,755 | B2 | 12/2008 | Borst et al. | |
| 7,828,064 | B2 | 11/2010 | Robichaux et al. | |
| 8,118,102 | B2 | 2/2012 | Robichaux et al. | |
| 8,171,991 | B2 | 5/2012 | Boyd | |
| 2002/0195255 | A1 | 12/2002 | Reilly | |
| 2004/0144571 | A1 | 7/2004 | Boyd | |
| 2006/0157253 | A1 * | 7/2006 | Robichaux et al. | 166/359 |
| 2007/0272403 | A1 * | 11/2007 | Robichaux et al. | 166/85.1 |
| 2008/0012317 | A1 * | 1/2008 | Johnson | E21B 7/067 285/321 |
| 2011/0155379 | A1 | 6/2011 | Bailey et al. | |

FOREIGN PATENT DOCUMENTS

| | | | | |
|---|---|---|---|---|
| FR | 2742177 | A1 * | 6/1997 | E02D 5/523 |
| WO | 2013/022449 | A1 | 2/2013 | |

OTHER PUBLICATIONS

PCT International Search Report and the Written Opinion of the International Searching Authority dated Feb. 28, 2014; International Application No. PCT/US2013/071441; International File Date: Nov. 22, 2013.

www.thrutubing.com; Lockable Swivel; Jan. 1. 2013; http://www.thrutubing.com/Downloads/TTS_PRODUCT_CATALOG_2O13.pdf#page=24.

* cited by examiner

CONTINUOUS ROTARY DRILLING SYSTEM AND METHOD OF USE

CROSS REFERENCE TO RELATED APPLICATIONS

This application claims priority to and the benefit of U.S. Provisional Application Ser. No. 61/605,447, filed Mar. 1, 2012, the full disclosure of which is hereby incorporated by reference herein for all purposes.

BACKGROUND OF THE INVENTION

1. Field of the Invention

The present invention relates to a system and method for excavating a wellbore. More specifically, the invention relates to a system and method for continuously rotating a drill string in the wellbore while lengthening the drill string.

2. Description of the Related Art

Hydrocarbon producing wellbores extend subsurface and intersect subterranean formations where hydrocarbons are trapped. The wellbores generally are created by drill bits that are on the end of a drill string, where a drive system above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid.

Drill strings are typically made up of tubular sections attached by engaging threads on ends of adjacent sections to form threaded connections. New tubular sections are attached to the upper end of the drill string as the wellbore deepens and receives more of the drill string therein. In a conventional rig operation, rotation of the drill string is temporarily suspended each time a tubular section is added to the drill string. When the drill string is not rotating, there is a risk that a portion of the drill string can adhere to a sidewall of the wellbore.

SUMMARY OF THE INVENTION

Described herein are example methods and systems for forming a wellbore. In one example a method of forming a wellbore in a subterranean formation is disclosed that includes providing a tubular string made up of tubular segments. The tubular string further includes connectors that axially adjoin adjacent segments. The connectors can be selectively changed between an unlocked configuration where the adjacent segments are rotatable with respect to one another and a locked configuration where the adjacent segments are rotationally affixed to one another. The method further includes changing at least some of the connectors from the unlocked configuration to the locked configuration to form a substantially rotationally cohesive portion of the tubular string. The substantially rotationally cohesive portion of the tubular string is inserted in the wellbore and rotated, so that when a drill bit is provided on an end of the tubular string, cuttings are removed from the subterranean formation to create the wellbore. In an example, the string is rotated by a rotary drive system that is disposed above an opening of the wellbore. The method can also include exerting a downward force onto the tubular string to urge the tubular string deeper into the wellbore. The method can optionally include temporarily suspending rotation of the rotationally cohesive portion of the tubular string for a period of time that so that the tubular string remains free from adhesion with a wall of the wellbore. In an example, the period of time the rotationally cohesive portion of the tubular string is suspended from rotation is less than a period of time to add a joint of pipe to a pipe string of threaded tubulars. In an example the method further includes drawing the tubular string from the wellbore, and changing connectors from the locked configuration to the unlocked configuration. Optionally, the tubing string can be deployed and stored on a reel.

Also disclosed herein is an assembly for use in a wellbore that includes a string of tubular segments that are affixed in an axial direction and connectors between adjacent tubular segments that are changeable between an unlocked configuration and a locked configuration. In this example, when unlocked tubular segments adjacent the unlocked connector are rotatable with respect to one another. Moreover, when in a locked configuration, tubular segments adjacent the locked connector are rotationally coupled with one another. The assembly further includes an earth boring bit on an end of the string of tubular segments, so that when the bit contacts a subterranean formation, a torque is applied to the string, and all connectors that are between the bit and where the torque is applied to the string are in a locked configuration, the bit excavates a wellbore in the formation. Optionally, an injector head can be included that exerts a force axially in the string to urge the bit against the subterranean formation. In an alternative, a portion of the string can be wound on a reel. All connectors on the string that are on a side of where the torque is applied to the string opposite the bit can be in the unlocked configuration. In one alternate embodiment, a pair of adjacent tubular segments define an upper tubular segment and a lower tubular segment, wherein the upper tubular segment comprises a pin portion that inserts into a box portion in the lower tubular segment. This example can further include a groove on an outer surface of the pin portion that registers with a groove on an inner surface of the box portion, and bearings set in the grooves that are in interfering contact with at least one of the pin and box portions when one of the upper and lower tubular segments are urged in an axial direction with respect to the other. The connectors can optionally include a torque transmitting clutch that selectively moves axially within a first slot on an outer surface of a first tubular segment and into a second slot that is on an outer surface of a second tubular segment that is adjacent the first tubular segment. In this example, the torque transmitting clutch is made up of a tongue that is axially inserted into the second slot when the connector is in the locked configuration, thereby rotationally coupling the first and second tubular segments. The assembly can optionally further include additional torque transmitting clutches that slide within slots on the respective outer surfaces of the first and second tubular segments and that are angularly spaced away from the first and second slots. A pin can optionally be included, which is set in a sidewall of one the first or second tubular segments that is selectively moved into interfering contact with the torque transmitting clutch to retain the connector in the locked configuration. A knob can alternatively be included on an outer surface of the string for selectively moving the pin.

Also disclosed herein is a system for forming a wellbore in a subterranean formation that is made up of a string of tubular segments that are axially affixed, so that substantially all of an axial force applied to a single tubular segment among the string of tubular segments is transferred to an adjacent tubular segment. The system includes connectors on the string for selectively rotationally coupling adjoining tubular segments and for selectively rotationally decoupling adjoining segments. Also included is an earth boring bit on an end of the string for excavating a wellbore in the formation. In an example embodiment of the system, a torque is applied at a location on the string, and wherein each of the adjoining tubular segments between the end of the string having the bit and the location are rotationally coupled, the bit is rotated for excavating the wellbore.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
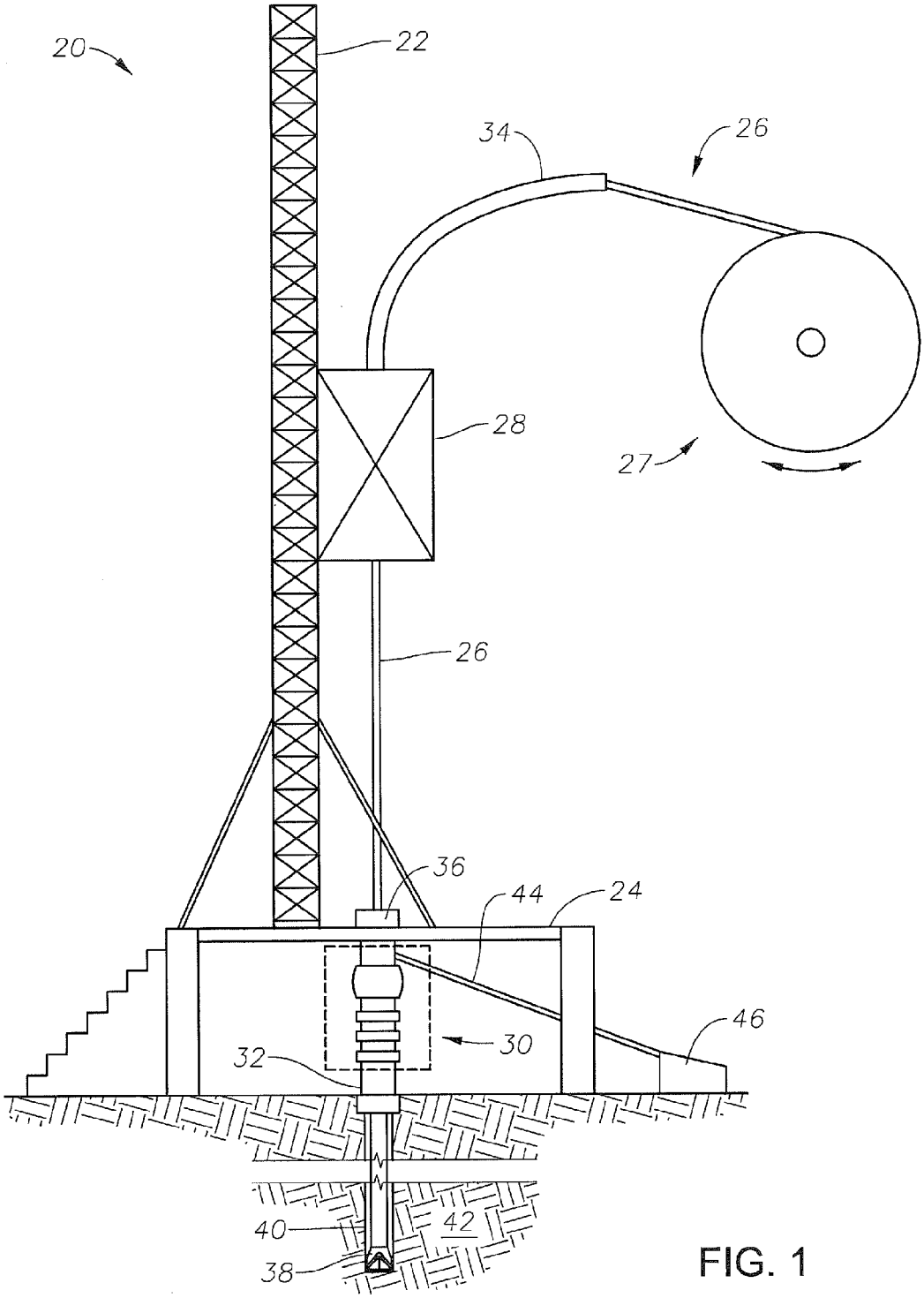
FIG. 1 is a side partial sectional view of an example embodiment of a drilling system having a drill string forming a wellbore in accordance with the present invention.

An example embodiment of a drilling system 20 is shown in a side and partial sectional view in FIG. 1. The drilling system 20 includes a vertical drilling mast 22 shown having a lower end mounted on a rig floor 24. Coiled tubing 26, which may be stored on a reel 27, feeds into an injector head 28 illustrated mounted on a side of the mast 22 a distance above the rig floor 24. Alternatively, the coiled tubing 26 can be segments that are coupled to one another as described below in more detail. The injector head 28 inserts the tubing 26 through a blowout preventer (BOP) 30 shown mounted on a wellhead 32; where both the BOP 30 and wellhead 32 are disposed below the rig floor 24. A curved gooseneck 34 guides the coiled tubing 26 into an upper end of the injector head 28. The system 20 further includes a Kelly bushing 36 shown set on the rig floor 24, wherein the Kelly bushing 36 transmits a rotational force onto the coiled tubing 26. A bit 38 disposed on a lower terminal end of the tubing 26 rotates with rotation of the coiled tubing 26. A wellbore 40 is shown being formed by downwardly urging the rotating drill bit 38 through a formation 42 below the wellhead 32. Thus, in an example the coiled tubing 26 with bit 38 define a drill string for subterranean excavation. Further illustrated in FIG. 1 is an optional return flow line 44 for directing fluids from the BOP 30 to a shale shaker 46.

Figure 2:
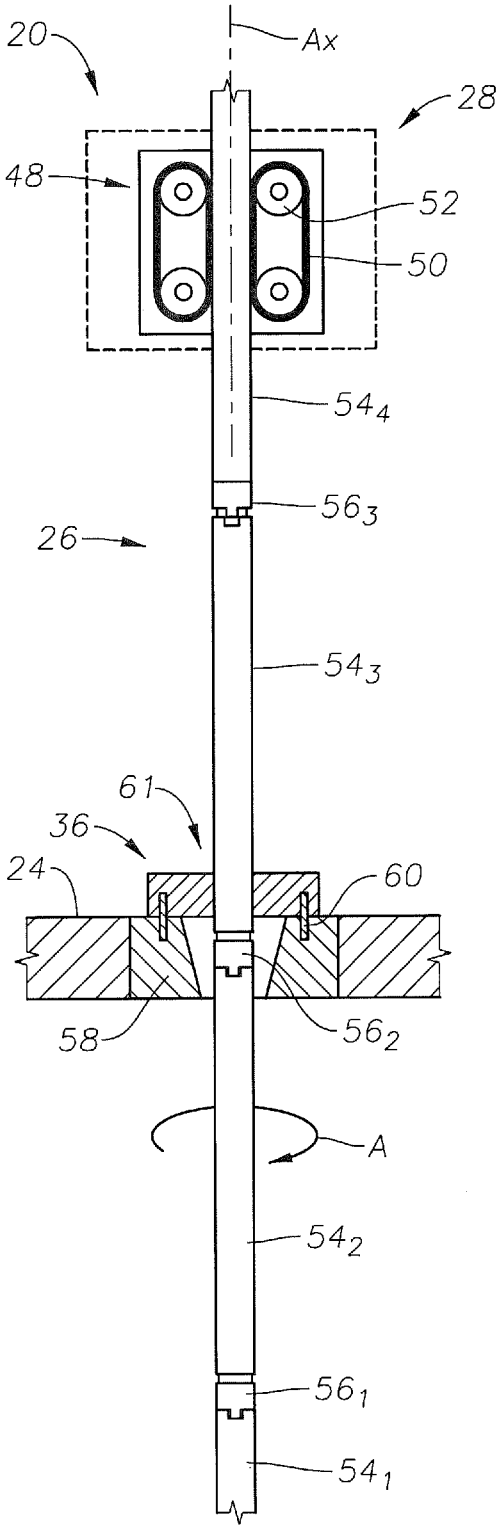
FIGS. 2-4 are side sectional views of an example of feeding the drill string of FIG. 1 into the wellbore of FIG. 1 in accordance with the present invention.

FIG. 2 schematically illustrates details of a portion of the coiled tubing 26, which include an injection head driver 48. The injection head driver 48 of FIG. 2 is part of the injection head 28 (represented by a dashed outline), and is shown downwardly urging the coiled tubing 26 through the rig floor 24. The example of the injection head driver 48 of FIG. 2 includes drive belts 50 that contact the outer surface of the coiled tubing 26 along a lateral distance substantially parallel to an axis $A_X$ of the string 26. The belts 50 loop around axially spaced apart rollers 52 that drive the belts 50 against the coiled tubing 26. The rollers 52 may be powered by a motor (not shown) in the injection head 28 or optionally may be powered by pressurized fluid. The example embodiment of the coiled tubing 26 of FIG. 2 is shown made up of a series of tubular segments $\mathbf{54}_{1\text{-}4}$ having connectors $\mathbf{56}_{1\text{-}3}$ disposed between each adjacent tubular segment $\mathbf{54}_{1\text{-}4}$. As will be discussed in further detail below, the connectors $\mathbf{56}_{1\text{-}3}$ may be selectively moved from an unlocked configuration, wherein adjacent segments $\mathbf{54}_{1\text{-}4}$ may rotate with respect to one another, to a locked configuration wherein adjacent segments $\mathbf{54}_{1\text{-}4}$ are rotationally affixed to one another.

Shown set in the rig floor 24 is an example of a rotary table 58 that provides a rotational force for rotating the coiled tubing 26 in an example direction as illustrated by arrow A. Kelly legs 60 are schematically provided to illustrate one example of how rotational force can be transferred from the rotary table 58 into the Kelly bushing 36. An axial aperture 61 is provided through the Kelly bushing 36 and through which the coiled tubing 26 is inserted. The outer periphery of the coiled tubing 26 and inner periphery of the aperture 61 are shaped so that the coiled tubing 26 is rotationally coupled with the Kelly bushing 36. Thus rotating the Kelly bushing 36 while the coiled tubing 26 is inserted in the aperture 61 rotates the coiled tubing 26. In the example of FIG. 2, segment $\mathbf{54}_3$ is inserted through the aperture 61 and rotates when the Kelly bushing 36 rotates. The connector $\mathbf{56}_2$ is in a locked configuration that rotationally couples segments $\mathbf{54}_2$ and $\mathbf{54}_3$. Accordingly, rotating segment $\mathbf{54}_3$, as shown by its insertion into a rotating Kelly bushing 36, rotates segment $\mathbf{54}_2$. In this example, any segment below segment $\mathbf{54}_2$ (e.g. on a side of segment $\mathbf{54}_2$ distal from rotary table 58) also rotates, as the connectors $\mathbf{56}_1$, and all other connectors below connector $\mathbf{56}_1$, are in a locked position. Connector $\mathbf{56}_3$, however, is in an unlocked configuration leaving segment $54_4$, which is above connector $56_3$, decoupled from segment $54_3$. In this example, segment $54_4$ therefore is not rotated as a result of section $54_3$ being rotated by the Kelly bushing 36.

Figure 3:
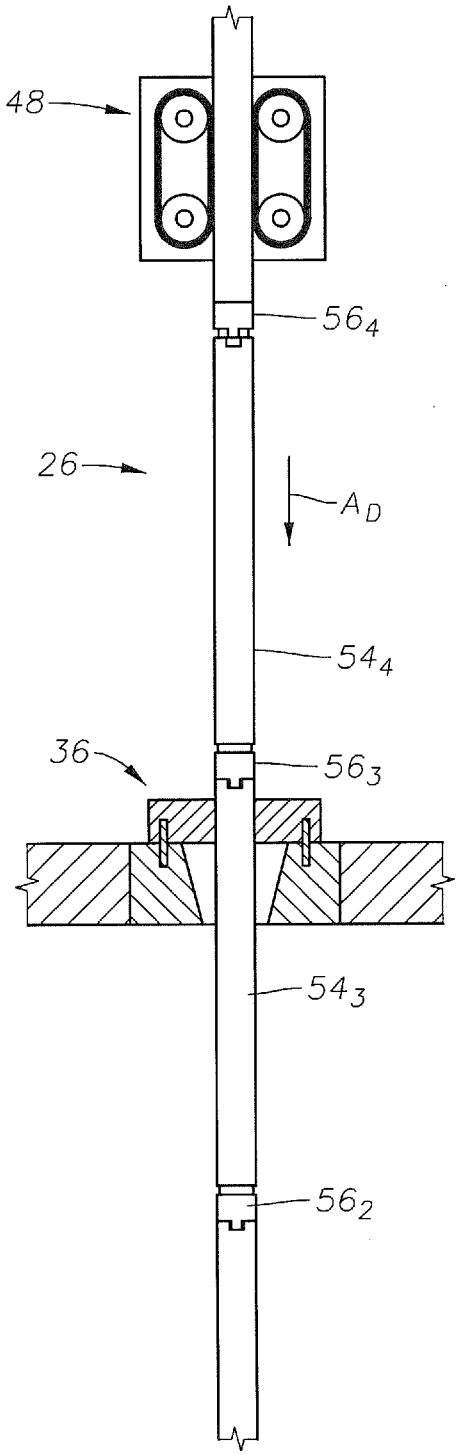
Figure 4:
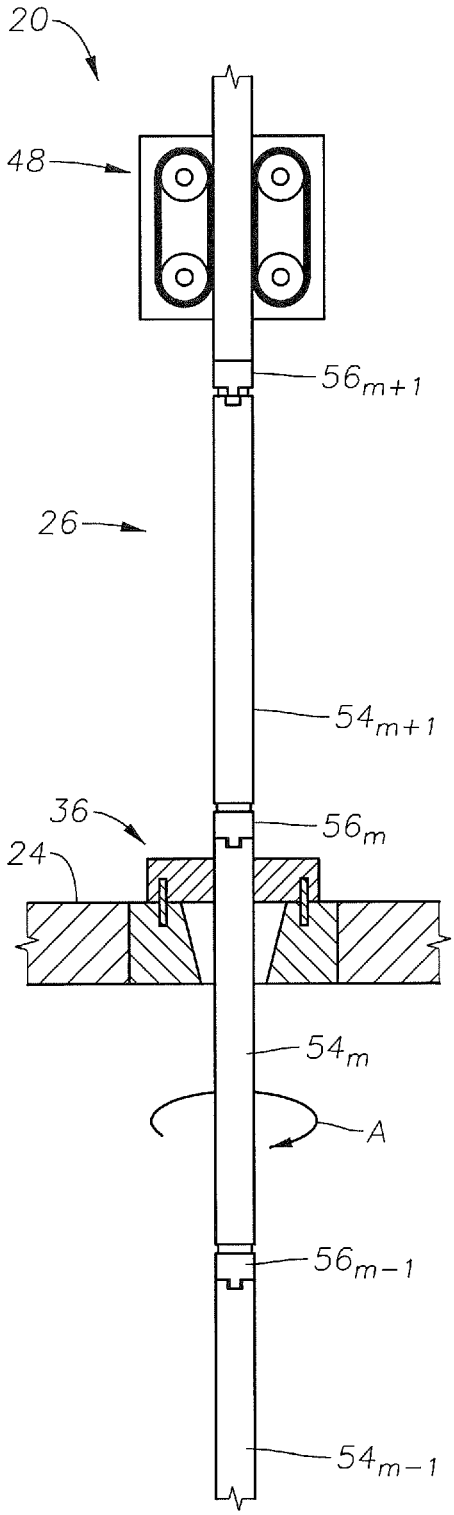

Referring now to the example of FIG. 3, the injection head driver 48 has urged the string 26 from its position of FIG. 2 downward in the direction of arrow $A_D$. Over time, connector $56_3$ reaches the Kelly bushing 36 and is set into a locked configuration to rotationally couple segments $54_3$ and $54_4$. Switching the connectors $56_{1\text{-}3}$ from an unlocked to a locked configuration (and vice versa), may be done manually on site. The short period of time required for switching the configuration of the connectors $56_{1\text{-}3}$ is significantly less than the amount of time taken for adding a drill string segment in a conventional threaded connection during conventional rig operation. Thus, significant advantages realized by use of the present invention include reducing drilling time and reducing a risk of a stuck tubular in a wellbore. FIG. 4 illustrates an example of operation of the drilling system 20 at a point in time later than that of FIG. 2 or FIG. 3, thereby depicting an example of continuity of feeding the coiled tubing 26 through the rig floor 24. Example segment $54_m$ is engaged by the Kelly bushing 36 and is attached to segment $54_{m+1}$ by connector $56_m$. Further illustrated in the example embodiment of FIG. 4 is that segment $54_{m-1}$ couples to a lower end of segment $54_m$ by connector $56_{m-1}$. In the example of FIG. 4 the designation in is greater than 3.

Figure 5:
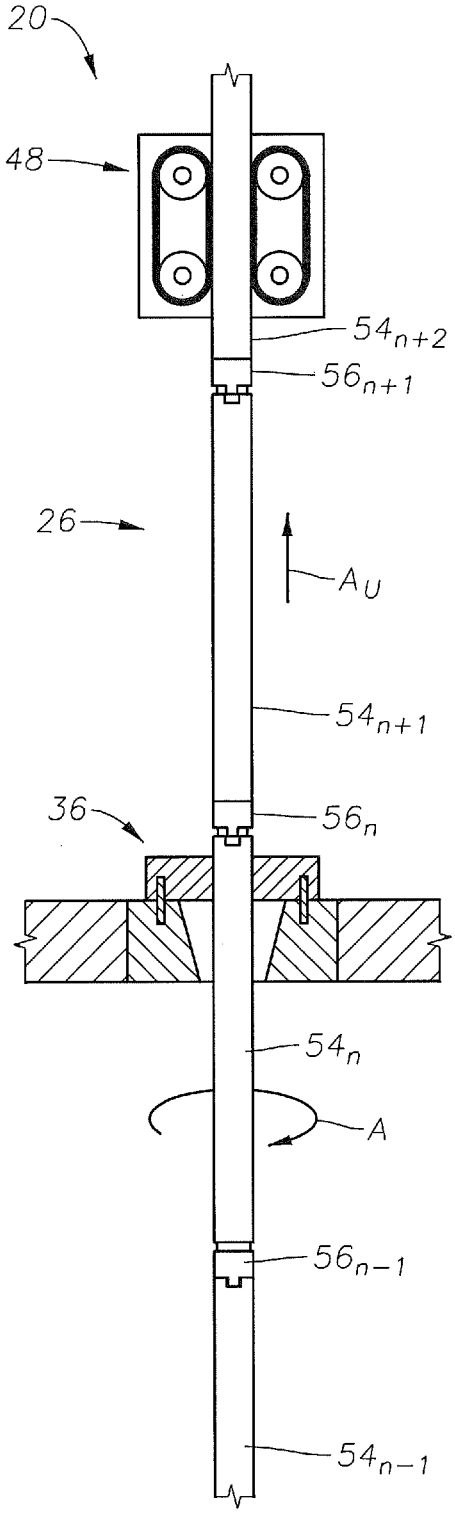
FIG. 5 is a side sectional view of an example of withdrawing the drill string of FIG. 1 from the wellbore of FIG. 1 in accordance with the present invention.

FIG. 5 illustrates a side sectional example of the drilling system 20, wherein the coiled tubing 26 is being drawn upward from a wellbore 40 (FIG. 1) and through the Kelly bushing 36 in the direction of arrow $A_u$. After being removed within the wellbore 40, the coiled tubing 26 can be stored back on the reel 27 (FIG. 1). In an example, reversing the direction of the injection head driver 48 from that of FIGS. 1-3 moves the coiled tubing 26 upward. In the example of FIG. 5, a segment $54_n$ is shown engaged by the Kelly bushing 36 and connected to segment $54_{n+1}$ by a connector $56_n$, wherein segment $54_{n+1}$ is above the Kelly bushing 36 and below the injection head driver 48. Further shown in the embodiment of FIG. 5 is a segment $54_{n+2}$ coupled to an upper end of segment $54_{n+1}$ by connector $56_{n+1}$ and segment $54_{n-1}$ coupled to a lower end of segment $54_n$ by connector $56_{n-}$. In the example of FIG. 5, the connector $56_n$ is in an unlocked configuration so that as segment $54_n$ rotates in the direction of arrow A, segment $54_{n+1}$ is rotationally decoupled from segment $54_n$ and unaffected by rotation of segment $54_n$. In a reverse step of operation from that illustrated in the examples of FIGS. 2-4, connector $56_n$ is changed from a locked configuration to an unlocked configuration when drawn above the Kelly bushing 36. Continued rotation of the coiled tubing 26 may be required when removing it from the wellbore 40 (FIG. 1) to prevent the string 26 from being stuck in the wellbore 40.

Figure 7:
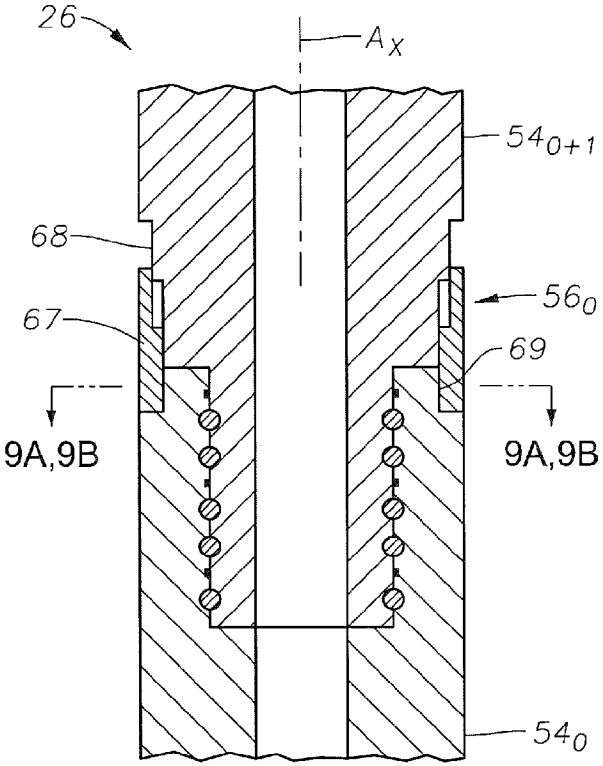
FIG. 7 is a side sectional view of an example of a connector in the drill string of FIG. 1 and in a locked configuration in accordance with the present invention.
Figure 6:
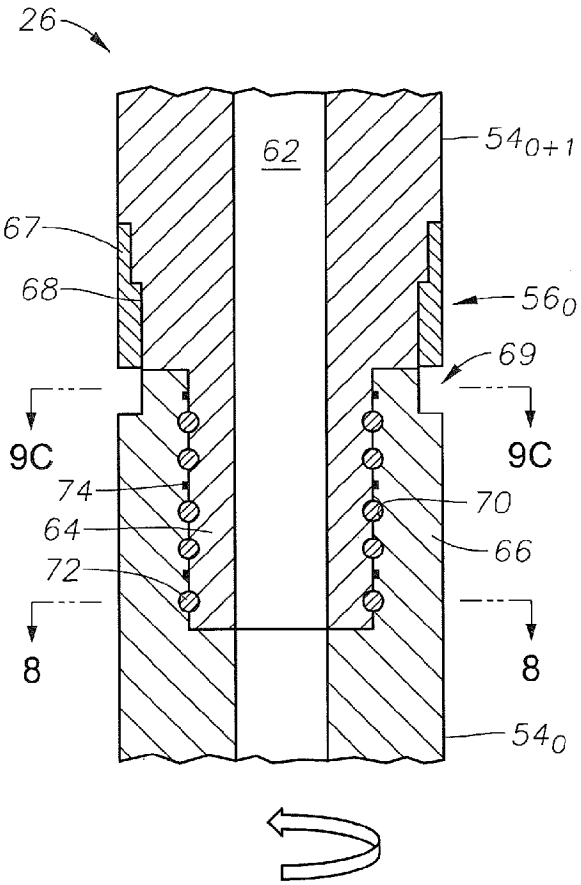
FIG. 6 is a side sectional view of an example of a connector in the drill string of FIG. 1 and in an unlocked configuration in accordance with the present invention.

FIGS. 6 and 7 illustrate detailed examples in side sectional view of an example string 26, and how adjacent segments $54_o$, $54_{o+1}$ of the string 26 may be rotationally coupled by a connector $56_o$. Referring to FIG. 6, an axial bore 62 in the string 26 extends through segments $54_o$, $54_{o+1}$ and with a diameter that remains substantially the same through the segments $54_o$, $54_{o+1}$. A lower end of segment $54_{o+1}$ has a reduced diameter which defines an annular pin 64 shown extending axially downward past an upper end of segment $54_o$. The pin 64 is shown inserted into a box 66, which is defined by where an upper end of segment $54_o$ has an enlarged inner diameter. A clutch member 67 is shown provided on an outer radial surface of segment $54_{o+1}$ adjacent an upper end of the pin 64. The clutch member 67 is set in a slot 68 which is formed along a portion of an outer diameter of segment $54_{o+1}$ and extends radially inward. Similarly, a slot 69 is formed along a portion of an outer diameter of segment $54_o$; slot 69 is on an upper end of segment $54_{o+1}$ and in registration with slot 68. Further illustrated in the example of FIG. 6 are a series of annular channels 70 shown having a substantially circular cross-section and being axially spaced apart along the interface between the respective outer and inner radial surfaces of the pin 64 and box 66. Thus in an example, about one half of each channel 70 is formed in the pin 64 with the corresponding other half of the channel 70 in the box 66. Spherical bearings 72 are shown set within the channels 70, and optional seals 74 are provided within the interface between the pin 64 and box 66. In the example of FIG. 6, the connector $56_o$ is in an unlocked configuration (with clutch member 67 only in slot 68 and not extending into slot 69), thereby allowing respective rotation between segments $54_o$, $54_{o+1}$.

Figure 7A:
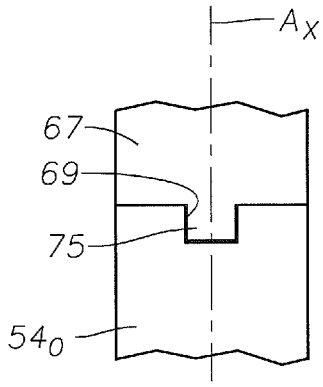
FIG. 7A is a side view of the connector of FIG. 7 in accordance with the present invention.

In the example of FIG. 7, the connector $56_o$ is shown in a locked configuration so that segment $54_o$ is rotationally coupled with segment $54_{o+1}$. In the embodiment shown, the clutch member 67 has a lower end that has been moved axially into slot 69 as clutch member 67 is moved partially out of slot 68. A side view of an example of the clutch member 67 and segment $54_o$ is shown in FIG. 7A; where a lower end of the clutch member 67 depends axially downward to define a tongue 75 shown inserted into slot 69. Respective axial sides of the tongue 75 and slot 69 are in contacting interference with one another. Moreover, axial sides of the tongue 75 and slot 69 that are substantially parallel with axis $A_X$ of the string 26 (FIG. 7). Thus when segment $54_o$ rotates, contact between the axial sides of the tongue 75 and slot 69 transfer rotational force from segment $54_o$, to the clutch member 67, and then to segment $54_{o+1}$; which in turn rotates segment $54_{o+1}$. Further in the example of FIGS. 6 and 7, the bearings 72 and channels 70 provide an axial support for the length of coiled tubing 26 extending below. Moreover, the presence of the bearings 72 reduces rotational friction between the segments $54_o$, $54_{o+1}$ when the segments $54_o$, $54_{o+1}$ are not rotationally coupled. Reducing the rotational friction increases rotational torque applied to the drill bit 38 (FIG. 1) that would otherwise be consumed by frictional resistance between adjacent and rotationally decoupled segments of the string 26.

Figure 8:
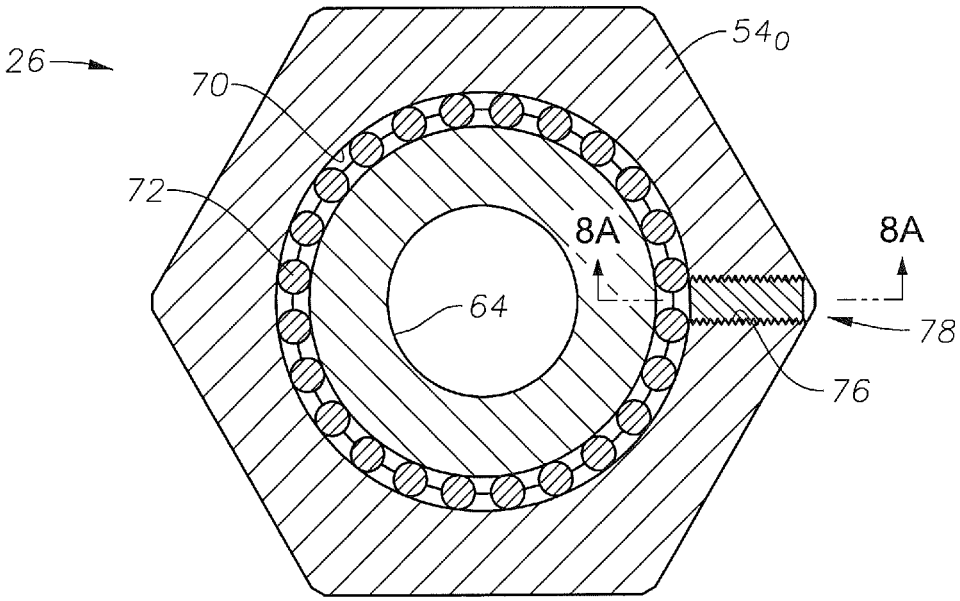
FIG. 8 is an axial sectional view of an example of a connector in the drill string of FIG. 1 in accordance with the present invention.
Figure 8A:
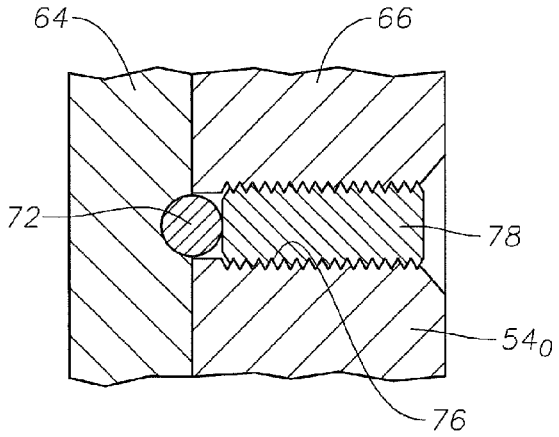
FIG. 8A is a side sectional view of a portion of the connector of FIG. 8 in accordance with the present invention.
Figure 8B:
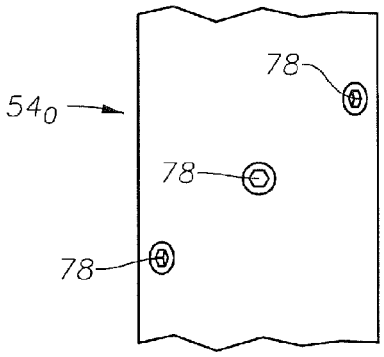
FIG. 8B is a side view of a portion of the connector of FIG. 8 in accordance with the present invention.

FIG. 8 is an axial sectional view of an example of the coiled tubing 26 and taken along lines 8-8 of FIG. 6. In the example of FIG. 8, the outer periphery of the coiled tubing 26 is shown as having a hexagonal shape, but can also have other configurations. Thus in this example, and as discussed above with reference to FIG. 2, aperture 61 would have a shape suitable for rotationally engaging the hexagonal outer surface of the coiled tubing 26. In the example embodiment of FIG. 8 channel 70 is generally circular and coaxially formed in the body of segment $54_o$ about axis $A_X$. A port 76 is shown formed radially inward in a sidewall of segment $54_o$ from its outer surface and intersects annular channel 70. The bearings 72 may be introduced into the channel 70 by insertion through the port 76. A plug 78 is shown inserted into port 76 to retain bearings 72 in the channel 70. FIG. 8A, which is a side sectional view taken along lines 8A-8A of FIG. 8, illustrates the plug 78 retained in segment $54_o$ adjacent bearing 72; and illustrating that plug 78 can be threadingly engaged with port 76. Moreover, the bearing 72 is shown set along the interface between the pin 64 and box portion 66 of segment $54_o$ to provide axial support for the tubing string 26 (FIG. 6) below bearing 72. A side view of segment $\mathbf{54}_o$ is provided in FIG. 8B and illustrates an example of adjacent plugs 78 angularly spaced apart from one another at each axial location of the channels 70 (FIG. 8).

Figure 9A:
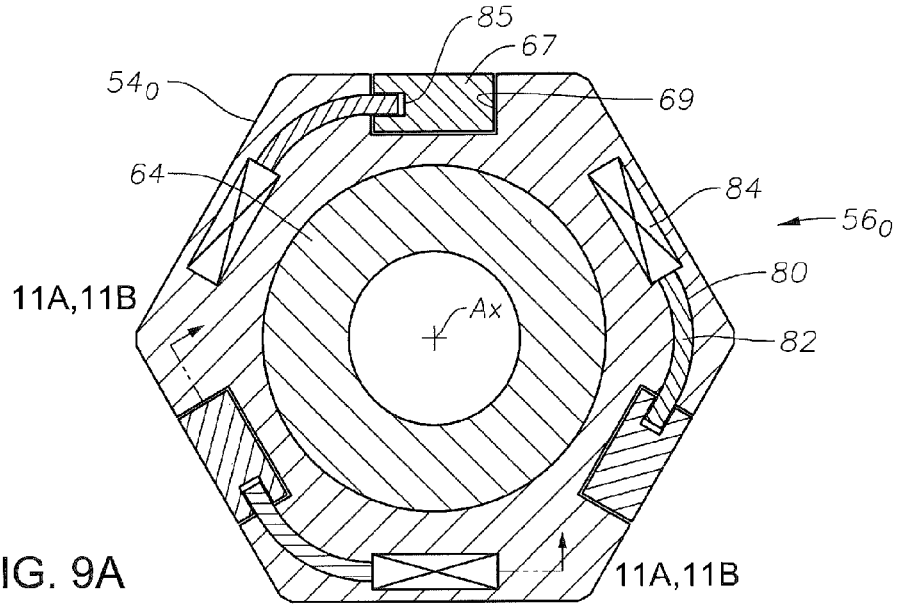
FIGS. 9A-9C are axial sectional views of an example of a connector between segments of the drill string of FIG. 1 changing from a locked to an unlocked configuration in accordance with the present invention.
Figure 9B:
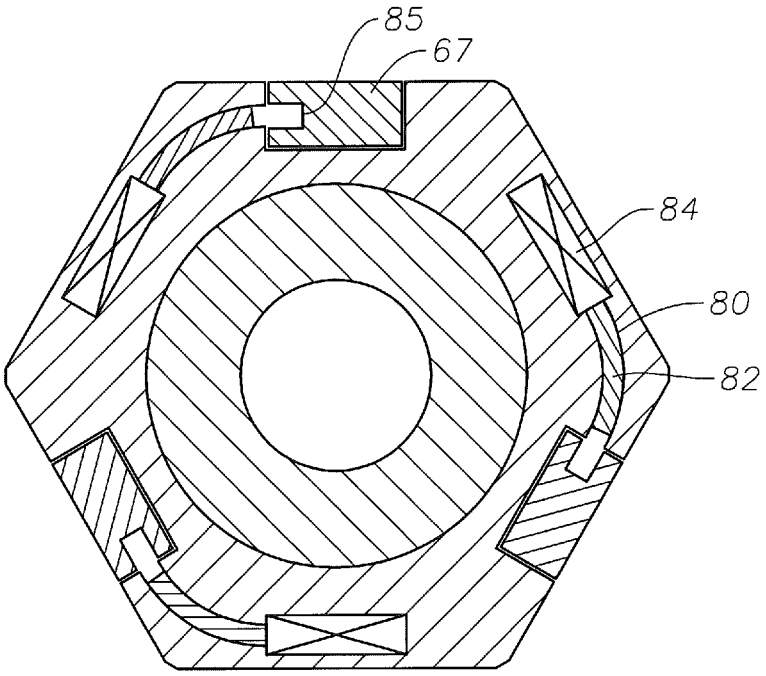
Figure 9C:
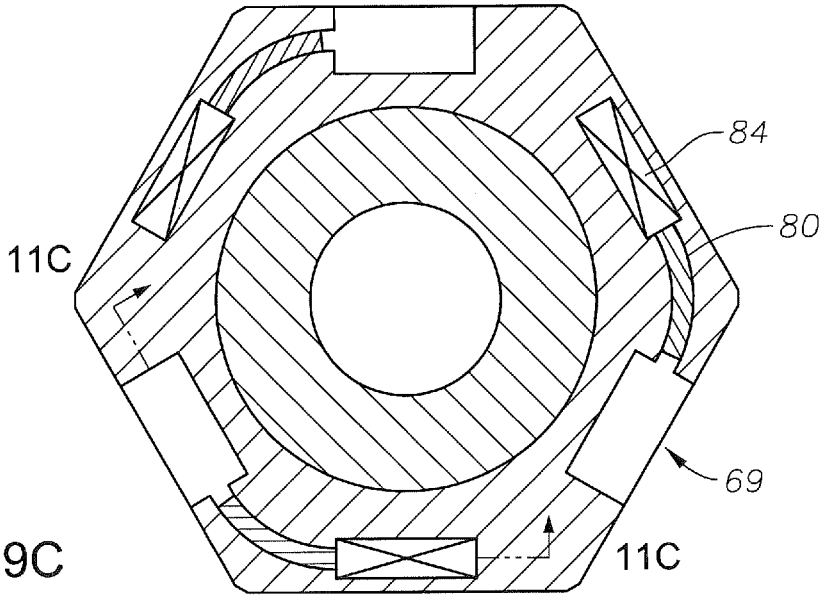

FIGS. 9A through 9C illustrate an example locking mechanism for retaining the clutch member 67, and depict the locking mechanism changing from a locked configuration to an unlocked configuration. While in the locked configuration, a portion of the clutch member 67 is in the slot 69. FIG. 9A, which is taken along lines 9A-9A of FIG. 7, shows an example of an elongated passage 80 formed in segment $\mathbf{54}_o$. The passage 80 follows a curved path through a sidewall of segment $\mathbf{54}_o$ which is generally normal to the axis $A_X$. An end of the passage 80 terminates into one of the axial sides of the slot 69. An elongate pin 82 is set within the passage 80 and driven by an actuator 84, also shown disposed in a sidewall of the segment $\mathbf{54}_o$. In the example of FIG. 9A, actuator 84 is at an end of the passage 80 opposite where the passage 80 intersects slot 69. The end of the pin 82 opposite the actuator 84 is shown extending into an opening 85 formed in a side of the clutch member 67. While the pin 84 extends through the passage 80 and into the opening 85, interference of the pin 84 in the clutch member 67 prevents the clutch member 67 from axially moving from its locked position into an unlocked position.

FIG. 9B illustrates an example of the actuator 84 having retracted the pin 82 from opening 85 in the clutch member 67 thereby allowing axial movement of the clutch member from a locked position to an unlocked position. It should be pointed out that while details of the actuator 84 are provided below, elements of an actuator are not limited to the embodiments illustrated herein but may be implemented by those skilled in the art. FIG. 9C illustrates an example of the clutch member 67 having axially slid out from the slot 69 so that adjacent segments may now rotate with respect to one another. In an example, locking mechanism for retaining the clutch member 67 includes one or more of pin 82 and actuator 84, and in an example, connector $\mathbf{56}_o$ includes one or more of clutch member 67, pin 82, and actuator 84.

Figure 10B:
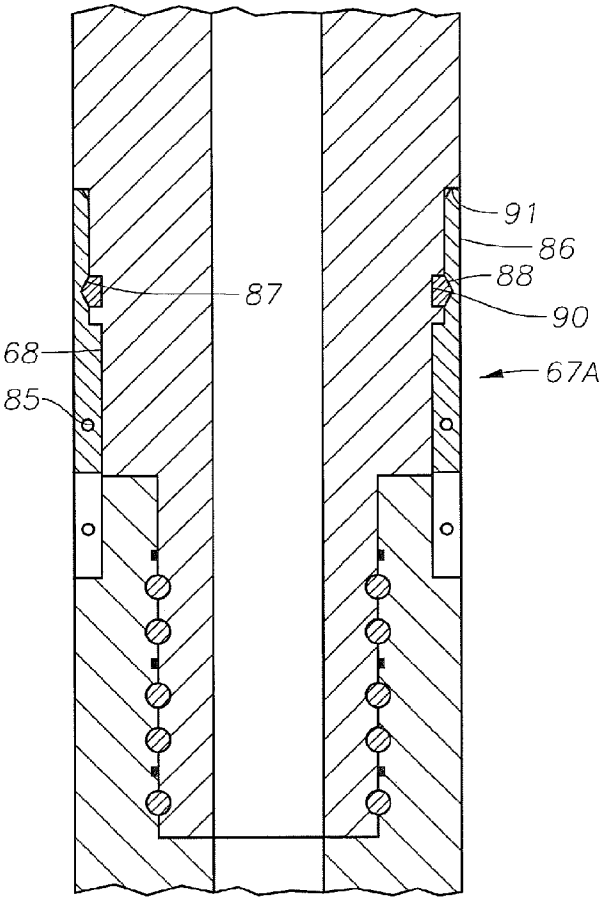
FIGS. 10A and 10B are side sectional views of an example of a connector in the drill string of FIG. 1 and changing from a locked to an unlocked configuration in accordance with the present invention.
Figure 10A:
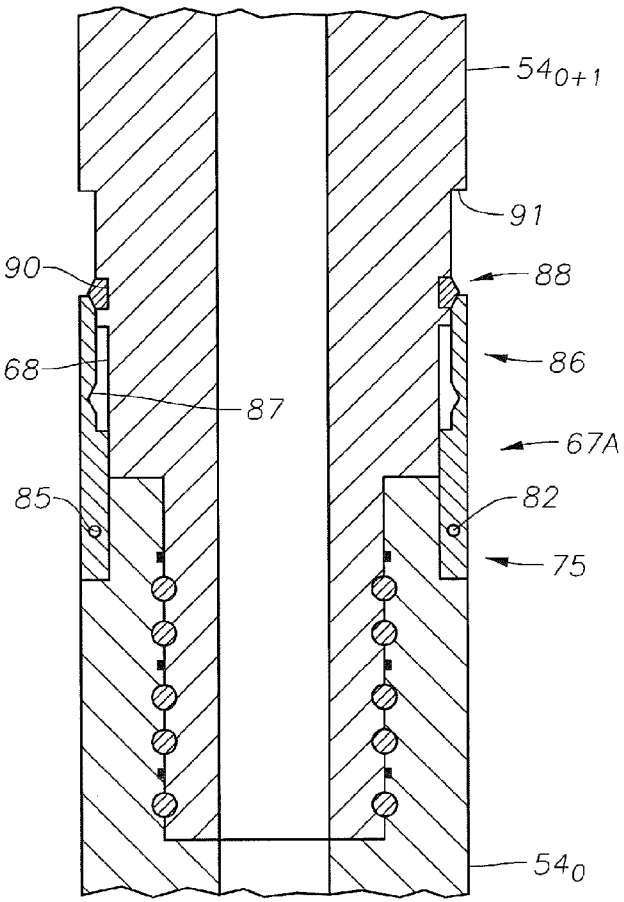

FIGS. 10A and 10B illustrate side sectional views of an alternate example of clutch member 67A for selectively rotationally engaging and disengaging segments $\mathbf{54}_o$, $\mathbf{54}_{o+1}$. In FIG. 10A clutch member 67A includes a leg 86 that depends axially away from the portion of the clutch member 67A having the tongue 75. The example of the leg 86 illustrated has an inner surface facing the segment $\mathbf{54}_{o+1}$ that is set radially outward from slot 68. Further, a profile 87 is provided on the surface of the leg 86 facing the slot 68 and set in a shape to match a shape of an outer surface of a detent 88. The detent 88 of FIG. 10A has a generally cylindrically shaped body with a conically shaped upper portion. The cylindrically shaped body of the detent 88 is shown set in an opening 90 formed on an outer surface of the segment $\mathbf{54}_{o+1}$, and with the conically shaped upper portion projecting radially outward from opening 90. Further in the example of FIG. 10A, the opening 90 depends radially inward from the outer surface of the segment $\mathbf{54}_{o+1}$ on a portion of the segment $\mathbf{54}_{o+1}$ between slot 68 and a shoulder 91. The shoulder 91 is downward facing and defined where the outer surface of the segment $\mathbf{54}_{o+1}$ projects radially inward. Referring now to FIG. 10B, the shoulder 91 is shown providing a backstop against which the upper end of the leg 86 is set when the clutch member 67A is moved into the unlocked configuration. Further shown in FIG. 10B, the detent 88 has been pressed radially inward by the inner surface of the leg 86 and a resilient member (not shown) set within the opening 90 exerts a radially outward urging force against the detent 88 to engage the detent 88 with the profile 87. Thus in the example of FIG. 10B, the detent 88 and profile 87 provide a retention means for maintaining the clutch member 67A in the unlocked position. Referring back to FIG. 10A, the pin 82 is shown set inside opening 85 in the clutch member 67A to help maintain the clutch member 67A in the locked position. Whereas in the example embodiment of FIG. 10B the pin 82 has been removed from the opening 85 thereby allowing the clutch member 67A to slide back fully into slot 68.

Figure 11A:
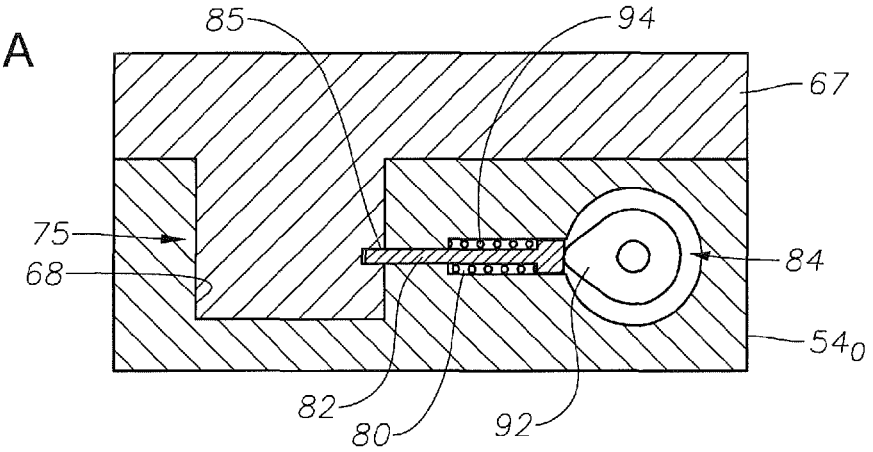
FIGS. 11A-11C are side sectional views of an example of a connector between segments of the drill string of FIG. 1 changing from a locked to an unlocked configuration in accordance with the present invention.
Figure 11B:
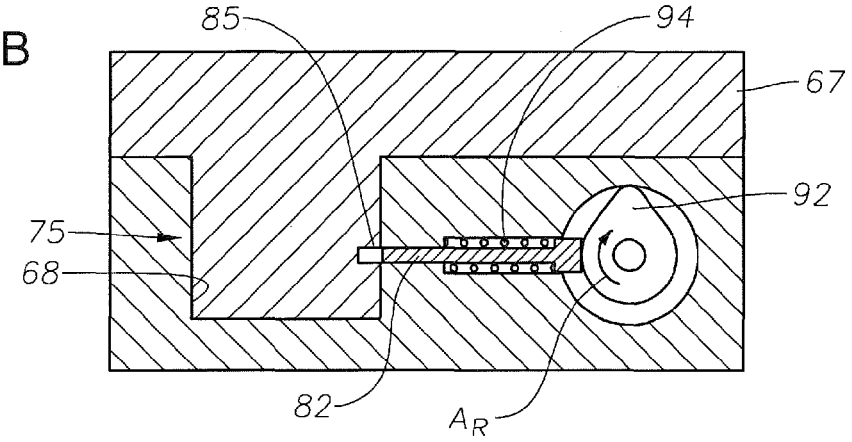
Figure 11C:
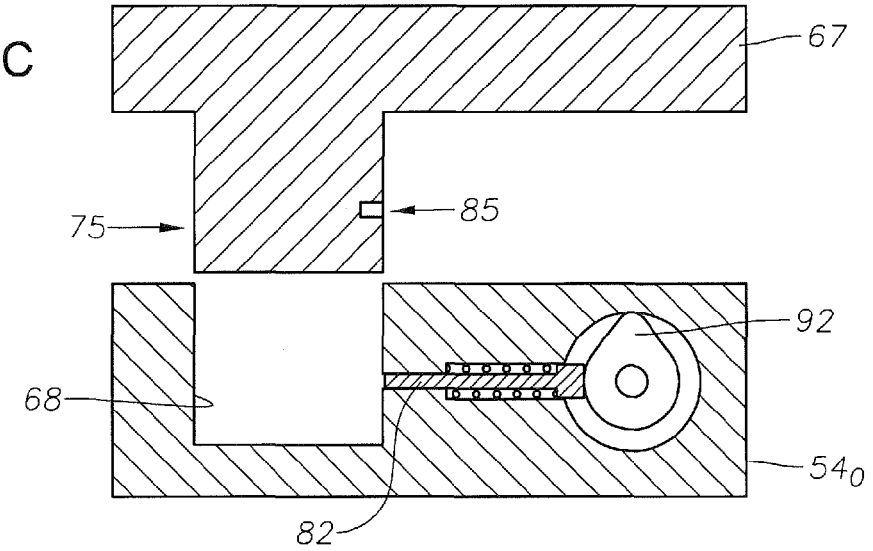

Referring now to FIGS. 11A-C, an example embodiment of the actuator 84 is shown in a side sectional view. FIGS. 11A and 11B, which are taken along lines 11A, 11B-11A, 11B from FIG. 9A, illustrate an example of how the actuator 84 can withdraw the pin 82 from opening 85. As shown, the example actuator 84 includes a knob element 92, which is an elongate member that is rotationally anchored about an end opposite where it contacts an end of the pin 82. In the example, the knob element 92 is aligned with the passage 80 in which the pin 82 resides. A spring 94 is shown set within the passage 80 and is for exerting a biasing force onto the pin 82 in a direction away from the tongue 75 of the clutch member 67. Thus, rotating knob member 92 in the direction of arrow $A_R$, as shown in FIG. 11B, moves the knob member 92 out of contact with the pin 82 and removes any retaining force the knob member 92 might exert on the pin 82. Moving the knob member 92 allows the spring 94 to axially elongate and urge the pin 82 from within opening 85 and into a portion of the passage 80 no longer occupied by knob member 92. Referring to the example of FIG. 11C, which is taken along lines 11C-11C of FIG. 9C, disengaging pin 82 from within opening 85 allows for axial movement of the clutch member 67 so that its tongue portion 75 be moved from within the slot 68 thereby rotationally releasing adjacent segments $\mathbf{54}_o$, $\mathbf{54}_{o+1}$ (FIG. 10A). Actuation of the knob element 92 may be performed manually by an operator positioned adjacent the Kelly bushing 36 (FIG. 1). Developing methods and devices for rotationally coupling and decoupling adjacent segments is within the capabilities of those skilled in the art. The knob element 92 can prevent accidently unlocking a connection when the system is in use.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of foaming a wellbore in a subterranean formation comprising:

a. providing a tubular string comprising tubular segments, and connectors axially adjoining adjacent segments that are selectively changeable between an unlocked configuration where the adjacent segments are rotatable with respect to one another and a locked configuration where the adjacent segments are rotationally affixed to one another;

b. changing connectors from the unlocked configuration to the locked configuration to form a substantially rotationally cohesive portion of the tubular string and that comprises connectors that are in the locked configuration;

c. inserting the substantially rotationally cohesive portion of the tubular string in the wellbore; and d. rotating the substantially rotationally cohesive portion of the tubular string, so that when a drill bit is provided on an end of the tubular string, cuttings are removed from the subterranean formation to create the wellbore e. exerting a downward force onto the tubular string to urge the tubular string deeper into the wellbore so that a one of the connectors is above an opening of the wellbore, temporarily suspending rotation of the rotationally cohesive portion of the tubular string, changing the one of the connectors from an unlocked to a locked configuration so that tubular segments adjacent to and above and below the one of the connectors are put into a rotationally cohesive configuration, and resuming rotation of the rotationally cohesive portion of the tubular string.

2. The method of claim 1, wherein step (d) comprises engaging the tubular string with a rotary drive system disposed above an opening of the wellbore.

3. The method of claim 1, wherein step (b) comprises temporarily suspending rotation of the rotationally cohesive portion of the tubular string for a short period of time so that the tubular string remains free from adhesion with a wall of the wellbore.

4. The method of claim 3, wherein the period of time the rotationally cohesive portion of the tubular string is suspended from rotation is significantly less than a period of time to add a joint of pipe to a pipe string of threaded tubulars in a conventional rig operation.

5. The method of claim 1, further comprising drawing the tubular string from the wellbore, and changing connectors from the locked configuration to the unlocked configuration.

6. The method of claim 1, wherein the tubing string is deployed and stored on a reel.

7. An assembly for use in a wellbore comprising:

lengths of coiled tubing that are coupled to one another in an axial direction to define a string of tubular segments, and that are storable on a reel;

connectors coupling each of the adjacent tubular segments to one another that are selectively changeable between an unlocked configuration and a locked configuration, so that when a single connector among the connectors is in an unlocked configuration, tubular segments adjacent the single connector are rotatable with respect to one another, and when the single connector is in a locked configuration, tubular segments adjacent the single connector are rotationally coupled with one another; and an earth boring bit on an end of the string of tubular segments, so that when the bit contacts a subterranean formation, a torque is applied to the string, and all connectors that are between the bit and where the torque is applied to the string are in a locked configuration, the bit excavates a wellbore in the formation.

8. The assembly of claim 7, wherein an injector head exerts a force axially in the string to urge the bit against the subterranean formation.

9. The assembly of claim 7, wherein a portion of the string is wound on a reel.

10. The assembly of claim 7, wherein all connectors on the string that are on a reel where the torque is not applied to the string are in the unlocked configuration.

11. The assembly of claim 7, wherein a pair of adjacent tubular segments define an upper tubular segment and a lower tubular segment, wherein the upper tubular segment comprises a pin portion that inserts into a box portion in the lower tubular segment.

12. The assembly of claim 11, further comprising a groove on an outer surface of the pin portion that registers with a groove on an inner surface of the box portion, and bearings set in the channels that are in interfering contact with at least one of the pin and box portions when one of the upper and lower tubular segments are urged in an axial direction with respect to the other.

13. The assembly of claim 7, wherein the connectors comprise a torque transmitting clutch that selectively moves axially within a first slot on an outer surface of a first tubular segment and into a second slot that is on an outer surface of a second tubular segment that is adjacent the first tubular segment, wherein the clutch maintains rotational coupling between the first and second tubular segments when the tubular string rotates clockwise and when the tubular string rotates counter-clockwise.

14. The assembly of claim 13, wherein the torque transmitting clutch comprises a tongue that is axially inserted into the second slot when the connector is in the locked configuration, thereby rotationally coupling the first and second tubular segments, wherein the tongue and the second slot interface one another along lateral sides that extend parallel with an axis of the tubular string.

15. The assembly of claim 14, further comprising a pin in a sidewall of one the first or second tubular segments that is selectively moved into interfering contact with the torque transmitting clutch to retain the connector in the locked configuration.

16. The assembly of claim 15, further comprising a knob on an outer surface of the string for selectively moving the pin.

17. The assembly of claim 13, further comprising additional torque transmitting clutches that slide within slots on the respective outer surfaces of the first and second tubular segments and that are angularly spaced away from the first and second slots.

18. A system for forming a wellbore in a subterranean formation comprising:

a string of tubular segments that are axially affixed, so that substantially all of an axial force applied to a single tubular segment among the string of tubular segments is transferred to an adjacent tubular segment;

slots formed on ends of the segments;

a connector provided on each tubular segment, and that comprises an annular torque transmitting clutche that is axially slideable with respect to the tubular segments, and tongue on an end of the clutch that selectively moves into interfering contact with a slot on an adjacent adjoining tubular segments for selectively rotationally coupling the adjacent adjoining tubular segments, and that selectively moves out of interfering contact with the slots in the adjacent adjoining tubular segments for selectively rotationally decoupling adjoining segments; and an earth boring bit on an end of the string for excavating a wellbore in the formation.

19. The system of claim 18, wherein when a torque is applied at a location on the string, and wherein each of the adjoining tubular segments between the end of the string having the bit and the location are rotationally coupled, the bit is rotated for excavating the wellbore.

* * * * *